United States Patent [19]

Hohorst

[11] Patent Number: 4,768,981

[45] Date of Patent: Sep. 6, 1988

[54] CONNECTING CLAMP FOR ELECTRICAL CONDUCTORS

[75] Inventor: Wolfgang Hohorst, Minden, Fed. Rep. of Germany

[73] Assignee: WAGO Verwaltungsgesellschaft mbH, Minden, Fed. Rep. of Germany

[21] Appl. No.: 850,283

[22] Filed: Apr. 10, 1986

[30] Foreign Application Priority Data

Apr. 16, 1985 [DE] Fed. Rep. of Germany ..... 3514099

[51] Int. Cl.[4] ..... H01R 4/48

[52] U.S. Cl. ..... 439/835; 439/828

[58] Field of Search ..... 339/200 R, 200 P, 204, 339/205, 206 R, 206 P, 207 S, 215 S, 219 R, 244 R, 249 R, 252 R, 253 S, 253 R, 253 L, 256 R, 256 S, 75 R, 248 R, 248 S, 75 MP, 75 P; 439/259, 296, 786, 789, 790, 816, 822, 828, 829, 835, 438

[56] References Cited

U.S. PATENT DOCUMENTS

| | | | |
|---|---|---|---|
| 842,771 | 1/1907 | Cove | 339/249 R |
| 4,095,868 | 6/1978 | Luithle | 339/205 |

FOREIGN PATENT DOCUMENTS

| | | | |
|---|---|---|---|
| 2005923 | 8/1971 | Fed. Rep. of Germany . | |
| 2344045 | 3/1975 | Fed. Rep. of Germany | 439/438 |
| 8301933 | 7/1983 | Fed. Rep. of Germany . | |
| 3237787 | 3/1984 | Fed. Rep. of Germany | 339/200 R |
| 1377824 | 9/1964 | France | 339/249 |

*Primary Examiner*—Eugene F. Desmond

*Attorney, Agent, or Firm*—Salter & Michaelson

[57] ABSTRACT

The invention concerns a connecting clamp for electrical conductors with a clamping spring disposed on a current bar, where said clamping spring clamps at least two conductors. The object is to manufacture such clamps economically and appropriately for automatic handling. This objective is achieved by providing a contact point for a conductor above and below the current bar, and by forming both clamping points jointly through a single clamping spring.

2 Claims, 1 Drawing Sheet

CONNECTING CLAMP FOR ELECTRICAL CONDUCTORS

BACKGROUND

1. Field of the Invention

The invention concerns a connecting clamp for electrical conductors which includes a clamping spring that enables the conductors to be securely clamped to a rigid current bar without incurring tilting moments and without the need for positive anchoring of the current bar.

2. Description of Prior Art

Connecting clamps of this type are known from the DE-GM 83 01 933. They are used to connect one or more plug-in electrical conductors, e.g. in the form of a solid conductor, a pin, or the like, with one or more electrical conductors which can be e.g. single-stranded solid conductors or flexible conductors. The known clamp according to the DE-GM 83 01 933 is intended in its simplest application to connect a solid conductor with a flexible conductor.

The flexible conductor, as a so-called outer wire, is inserted into a contact point which is formed below the current bar between the lower edge of the recess in one leg end of the clamping spring and the current bar. The solid conductor, as a so-called inside conductor, is inserted into a contact point which is formed above the current bar between the latter and a spring tab, which is punched out from the flat material of the clamping spring. However, it has appeared that this solid-conductor contact point according to the DE-GM 83 01 933 has disadvantages.

A first disadvantage occurs by forming the spring tab out of the flat material of the clamping spring which weakens the force of the clamping spring, whereby the spring must be dimensioned larger. Another disadvantage occurs by the requirement that the clamping spring must be anchored on the current bar solidly and in the proper position. A holding part is used for this, which is formed integrally with the current bar and which engages the spring-tab punch-out of the clamping spring. If the spring tab were not anchored, the spring tab would push away the clamping spring from the current bar. Furthermore, intolerable clamping forces could be transmitted, from the spring tab to the insulating housing. Moreover, anchoring the clamping spring on the current bar requires a relatively high production and assembly expenditure and is not suitable for automatic handling.

OBJECTS AND ADVANTAGES

The object of the invention therefore is to develop further the clamp according to the DE-GM 83 01 933, so that it can be manufactured with less expense, with more attention to automation, and also in smaller dimensions.

According to the invention, this object is achieved as follows: The electrical conductor that is inserted above the current bar is securely clamped approximately in the area of the recess of one leg end of the clamping spring by means of the other leg end of the clamping spring, which extends through said recess. It is also clamped securely between said other end of the clamping spring and the current bar.

With use of the clamp according to the invention, both the contact point above the current bar and the contact point below the current bar lie approximately in the area of the recess of the leg end of the clamping spring. Thus the tilting moments against the clamping spring, resulting from the clamping forces of the legs on the conductors are substantially eliminated. Accordingly, no anchoring of the clamping spring on the current bar is required, but rather the clamping spring can simply be pushed onto the current bar and is held thereon solely by virture of its spring force. This is appropriate for automatic handling, and is extremely economical in manufacture and assembly, especially since the material consumption for the current bar is much smaller compared to the material consumption for a current bar according to DE-GM 83 01 933.

Despite the two contact points that have been formed, the clamping spring is intrinsically self-supporting and in no case can it transmit clamping forces to the insulating housing of the clamp. A special advantage also is that the contact point does not require a cut-out or a punch-out in the clamping spring for the inside solid-conductor connection. Previously this was indeed the case through the punched-out spring tab. Thus the spring force of the clamping spring can be used fully to clamp the electrical conductors, and the clamp accordingly can be dimensioned smaller.

In principle it is possible to insert the inside solid conductor directly above the current bar between the leg end of the clamping spring which makes contact therewith and the current bar itself, since the clamping spring which includes the two clamping legs has a round opening formed in the leg through which the other leg and the current bar extends. This round opening is also used as a means for extending the solid conductor therethrough in oriented relation.

PREFERRED EMBODIMENT OF THE INVENTION

An especially preferred embodiment of the invention, however, has a current bar which has an upwardly extending portion in this area, i.e. at that end which is removed from the contact point. The upwardly extending portion is directed upwardly toward the leg end that extends through the opening, and it urges that leg end upwardly to retain it in spaced relation from the current bar, so that the solid conductor can be inserted even more easily the housing of the connecting clamp.

BRIEF DESCRIPTION OF DRAWINGS

An embodiment of the invention will be described in more detail below by way of the drawings.

Figure 1:
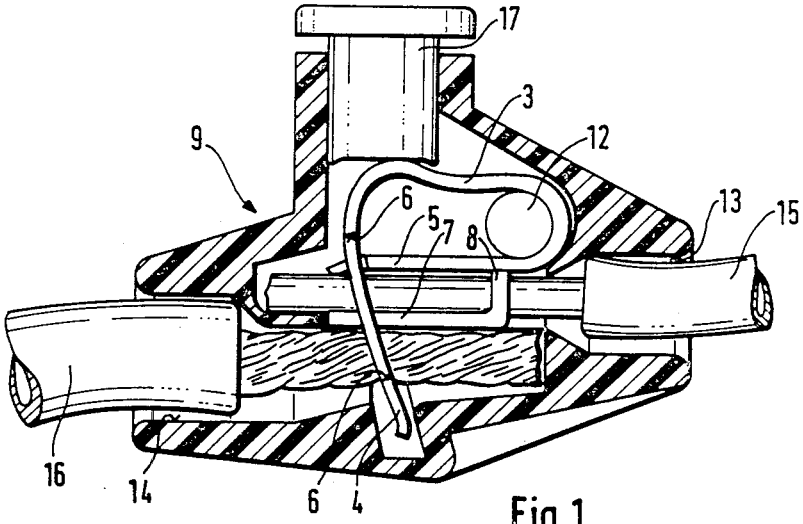
FIG. 1 is a longitudinal sectional view through the housing of the connecting clamp according to the invention.
Figure 2:
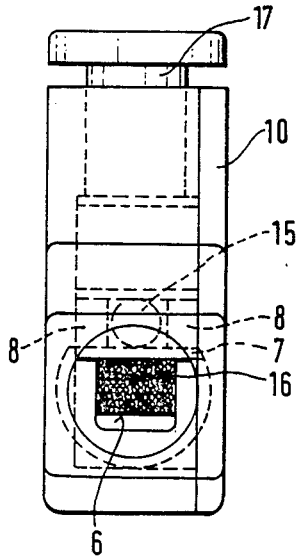
FIG. 2 is a front elevational view of the clamp illustrated in FIG. 1.

The drawing shows a clamping spring 3 having two leg ends 4 and 5, which are bent towards one another in such a fashion that the one leg end 5 which has a free end extends through an opening 6 in the other leg end 4.

A current bar 7 located in an insulated housing 9 is designed so as to be intrinsically rigid. Formed on the rearward end of the current bar 7 are spaced upwardly extending edges 8.

The current bar 7 and the clamping spring 3 are inserted into an appropriately formed cavity as located in the insulating housing 9, which is closed by means of a lateral cover 10. The cavity in the housing is dimensioned in such a way that the current bar is fixed rigidly in position therein. Before the current bar 7 is inserted into the housing, the current bar 7 is inserted into the opening 6 of the leg 4 of the clamping spring 3 and the clamping spring 3 is fixed in position in the housing 9 solely by a peg 12. The housing 9 has two conductor insertion passageways 13 and 14 for the inside connection of a solid conductor 15, which is to be inserted above the current bar 7, and for the outside connection of e.g. a flexible conductor 16, which is inserted below the current bar 7. To fix the flexible conductor 16 in place, a contact point, which is formed below the current bar 7 by the lower edge of the opening 6 must first be depressed by exerting a downward pressure on the pressure element 17. To insert the solid conductor 15 into the clamp opening 6 no previous opening process is needed and the solid conductor 15 need only be urged between the upstanding edges 8 of the current bar 7 through the opening in the spring 3 and into contact with the clamping point as defined by the free end of the spring leg 5.

I claim:

1. A connecting clamp for electrical conductors, comprising an insulating housing having a front portion with an entry hole for the introduction of a first conductor therein and a rear portion with an entry hole for the introduction of a second conductor therein, a clamping spring located in said housing formed of a flat, flexible material and including a first leg located adjacent to the front portion of said housing and having an opening formed therein defined by an upper edge and a lower edge, a second leg joined to said first leg and being bent relative thereto to form a spring loop having a closed face that is located adjacent to the rear portion of said housing, said second leg having a free end that extends through said opening in said first leg, a current bar located in said housing and extending through said opening in the first leg of said clamping spring and being disposed substantially in underlying parallel relation with respect to the second leg of said clamping spring, said first conductor extending underneath said current bar through the opening in the first leg of said clamping spring and being clamped between said current bar and the lower edge of said opening thereby forming an underneath clamping point, said second conductor extending over said current bar and through the opening in the first leg of said clamping spring and being clamped between said current bar and said free end of said second leg of said clamping spring thereby forming an upper clamping point, said upper clamping point and said underneath clamping point being disposed approximately one above the other so that a tilting moment exerted against the clamping spring is prevented and a positive anchoring of said clamping spring on said current bar is not required.

2. A connecting clamp as claimed in claim 1, said current bar including an upstanding portion located adjacent to the rear position of said housing, said upstanding portion engaging the underside of said second leg of said clamping spring for spacing said second leg away from said current bar in the area adjacent to the rear portion of said housing in order that the second conductor can be inserted more easily between said current bar and the second leg of said clamping spring.

* * * * *